US005687905A

United States Patent [19]

Tsai

[11] Patent Number: 5,687,905

[45] Date of Patent: Nov. 18, 1997

[54] ULTRASOUND-MODULATED TWO-FLUID ATOMIZATION

[76] Inventor: Shirley Cheng Tsai, 5702 Highgate Ter., Irvine, Calif. 92715

[21] Appl. No.: 523,403

[22] Filed: Sep. 5, 1995

[51] Int. Cl.[6] ..... B05B 17/04

[52] U.S. Cl. ..... 239/4

[58] Field of Search ..... 239/4, 102.1, 102.2, 239/416.5, 417, 423, 424

[56] References Cited

U.S. PATENT DOCUMENTS

| | | | |
|---|---|---|---|
| 3,015,449 | 1/1962 | Meyer | 239/417 |
| 3,537,650 | 11/1970 | Peczeli et al. | 239/405 |
| 3,756,575 | 9/1973 | Cottel | 261/1 |
| 3,970,250 | 7/1976 | Drews | 239/102.2 |
| 4,081,233 | 3/1978 | Kitajima et al. | 239/102.2 X |
| 4,541,564 | 9/1985 | Berger et al. | 239/102.2 |
| 4,871,489 | 10/1989 | Ketchem | 264/9 |
| 4,978,067 | 12/1990 | Berger et al. | 239/102.2 |
| 5,104,042 | 4/1992 | McKown | 239/102.2 |
| 5,219,120 | 6/1993 | Eherenberg et al. | 239/11 |
| 5,224,651 | 7/1993 | Stahl | 239/102.2 X |
| 5,330,100 | 7/1994 | Malinowski | 239/102.2 |

*Primary Examiner*—Andres Kashnikow
*Assistant Examiner*—Steven J. Ganey

[57] ABSTRACT

The present invention is a dramatic enhancement of the two-fluid atomization art through the discovery of a method of causing resonance between capillary waves in the ultrasound range in a flowing liquid stream and the waves created at the surface of that stream of liquid by an impinging gas stream. In the present invention, the surface of a stream of liquid issuing from the outlet or nozzle of an ultrasonic atomizer is impinged upon by a stream of gas. That impinging stream of gas then develops, at the surface of the liquid stream already sustaining its own wave motion, a flow of gas substantially parallel to the flow of the liquid stream that moves faster than that surface of the liquid stream. The flow of the gas at the surface of the liquid stream moves sufficiently faster than the surface of the liquid stream to generate waves at the surface of the liquid stream. The wavelength of the waves generated by the impinging gas on the surface of the liquid stream are modulated by velocity control of the impinging gas stream and resonate with the liquid stream waves. The resonance results in an atomization wherein the droplets are smaller and the droplet size distribution is reduced over prior art ultrasonic atomizers.

14 Claims, 15 Drawing Sheets

ULTRASOUND-MODULATED TWO-FLUID ATOMIZATION

BACKGROUND OF THE INVENTION

The present invention relates to the production of droplets by application of ultrasonic vibration in two-fluid atomization.

Producing droplets of predictable size within a narrow droplet size distribution has been the admirable goal of many prior art attempts. It is well known that merely producing a stream with the desired average droplet size can be of little value. Heat and mass transfer characteristics, as well as other process parameters, change significantly for droplets within the range of diameters typically produced by many prior art devices. Process calculations for modeling such processes with wide droplet size distribution must be subdivided into size groupings and require sophisticated computer-based solutions. Actual operation of processes with wide droplet size distribution generally produces results which are less stable and less predictable than those in which droplet size is effectively narrowed.

Two-fluid atomizers are widely used in applications where fine droplet size distributions are desired. It is a requirement of two-fluid atomization that a jetted stream of liquid be significantly impinged upon by a stream of gas to enhance entrainment of the gas into the jetted liquid stream and subsequent dispersal of the liquid into droplets. As described in U.S. Pat. No. 3,537,650 for a two-fluid atomizer, air accelerated to sonic velocity in an annular space around a liquid-carrying tube is impinged on the liquid jets spraying from holes in the end of the tube. It is critical to note that sonic waves are established in the fluidizing gas before it contacts the liquid. A simple but severe limitation concerning the use of sonic velocity gas in two-fluid atomization is that sonic velocity must be achieved to provide atomizing wave energy for the liquid, but atomizing gas flow cannot increase above the rate at which sonic velocity is effected.

In contrast to two-fluid atomization, atomization by ultrasonic atomizers, sonic probes, and the like are disclosed in the prior art in devices that flow liquid over a surface vibrating in the ultrasonic (and in some prior art devices and as used herein, the sonic) range to induce wave motion in the liquid to effect atomization. A device for which modulation of the output of ultrasonic frequency from an ultrasonic atomizer to a flowing liquid stream may be achieved is described in U.S. Pat. No. 4,978,067 (Berger et al '067). The device itself is exemplary of ultrasonic atomizers which create a set of waves, called capillary waves, in fundamental and/or certain harmonic wavelengths at the interface between a stream of pressurized liquid and a solid surface vibrating in the ultrasonic range, although the device of Berger et al '067 exhibits an integral extension of the housing (a nozzle, as used herein) used to enhance amplitude of the waves in the liquid stream issuing from the extension. The innovation of Berger et al '067 is the enhancement of wave amplitude in the liquid stream film interface at the nozzle outlet over other piezoelectric ultrasonic atomizers without such nozzles.

The capillary wave mechanism of ultrasonic atomization of a liquid jet has been well accepted since its first demonstration in about 1962. Specifically, capillary waves are formed in the liquid film of a pressurized, flowing liquid stream contacting a solid surface that is vibrating at frequencies in excess of 10 kHz. An increase in the vibrational amplitude of a vibrating surface results in a proportional increase in the amplitude of the liquid capillary waves in the liquid film. An adequately designed ultrasonic atomizer will maintain contact between the vibrating solid surface and the flowing liquid stream until a wave amplitude is developed in the liquid film contacting the solid surface sufficient to cause atomization at some point after the liquid is no longer in contact with the vibrating surface. In Berger et al '067, the vibrating solid surface is the inside of circular diameter tube through which the pressurized, flowing liquid stream moves, wherein the tube vibrates substantially parallel to the flow of the liquid stream.

Atomization in ultrasonic atomizers occurs when (1) the vibration amplitude of the solid surface increases the amplitude of the capillary waves of the liquid stream film above a level at which wave stability can be maintained and (2) the pressurized, flowing liquid stream is expanded into a lower pressure gas, as the continuous phase, of sufficient volume and/or flow rate to permit desired droplet formation. The resulting median drop size from ultrasonic atomizers is proportional to the wavelength of the capillary waves which is, in turn, determined by the ultrasonic frequency in accordance with the Kelvin equation.

U.S. Pat. No. 4,871,489 (Ketcham '489) uses a multi-pore plate vibrating at ultrasonic frequency to generate small droplets at the pore outlet which are quickly whisked away by an air stream to be dried for use as refractory metal oxide. The droplet sizes generated by the device in Ketcham '489 are not disclosed, although there is extensive discussion of the final, dried particle sizes. The throughput of each outlet pore is quite small, since the pores measure 1–3 microns at the inlet and flare up to 20 microns across at the outlet, causing the droplets to be larger than the pore diameter. It is well known in the art that droplets generated in the apparatus of Ketcham '489 occur through the mechanism of Rayleigh mode, wherein the droplet diameter is greater than the pore diameter. No jet of liquid is generated at the outlet pore. U.S. Pat. No. 3,756,575 discloses a sonic probe which is flanged at the end so that the vibrating liquid flows to the bottom side of a horizontal plate substantially out of the flow of the air stream into which the droplets will be formed. A mere gentle "rain" of droplets is generated from the vibrating surface. U.S. Pat. No. 5,219,120 discloses a piezoelectric ultrasonic atomizer whose liquid stream is fully atomized into a spray before being impinged upon by two air streams to improve radial distribution of the droplets without indication of its effect on droplet size distribution or energy consumption. It would appear the patents cited in this paragraph are not directed to two-fluid atomization, the requirements being that a definable jet of liquid be impinged upon to a significant degree by a gas stream.

The prior art has not adequately developed the use of ultrasound in two-fluid atomization. It is the primary object of the present invention to take advantage of the benefits of ultrasound to control the drop size and size distribution in two-fluid atomization.

SUMMARY OF THE INVENTION

The present invention is a dramatic enhancement of the two-fluid atomization art through the discovery of a method of causing resonance between capillary waves in the ultrasound range in a flowing liquid stream and the waves created at the surface of that stream of liquid by an impinging gas stream. In the present invention, the surface of a stream of liquid issuing from the outlet or nozzle of an ultrasonic atomizer is impinged upon by a stream of gas. That impinging stream of gas then develops, at the surface of the liquid stream already sustaining its own wave motion, a flow of gas substantially parallel to the flow of the liquid stream that moves faster than that surface of the liquid stream. The flow of the gas at the surface of the liquid stream moves sufficiently faster than the surface of the liquid stream to generate waves at the surface of the liquid stream. The wavelength of the waves generated by the impinging gas on the surface of the liquid stream are modulated by velocity control of the impinging gas stream.

The dramatic results of the present invention are achieved when the wavelength of the waves generated by the impinging gas substantially match at least one of the wavelengths of the capillary waves generated by ultrasonic vibrations at the surface of the liquid stream. At such a matching or resonance of a wavelength or wavelengths, the energy from the waves generated by the impinging gas quickly increases the total wave amplitude in the stream of liquid, disrupting and quickly shattering the stream of liquid, creating an unexpected narrowing of overall droplet size distribution. Also unexpectedly, since wave energy of the impinging gas is constructively, instead of destructively, added to the wave energy in the stream of liquid, the ultrasonic atomizer energy may be advantageously reduced over prior art designs. The present invention thus permits the use of ultrasonic power levels below and liquid flow rates above the threshold values for prior art ultrasonic atomization.

Two-fluid atomizers are used in many applications to achieve finer (smaller) average droplet sizes than their simpler pressure atomizer counterparts. In virtually any application in which two-fluid atomization is or can be used, the present invention can be advantageously used. Although the specific examples described herein relate to generation of narrow droplet size distribution for Newtonian liquids, it will be clear to the skilled person that the concept of matching a wavelength or wavelengths of waves in a liquid stream generated by an impinging gas to at least one of the wavelengths in the ultrasound range of the capillary waves in that liquid stream will be equally useful and applicable to suspensions, dispersions or non-Newtonian liquids as well. Suspensions, dispersions, non-Newtonian and highly viscous liquids have been sufficiently studied with respect to wave generation due to ultrasonic vibration and by impinging gas streams so that such liquids may be advantageously used in a manner similar to that described herein for Newtonian or low viscosity liquids to achieve the objects of the present invention.

The prior art has not developed an ultrasound-modulated, two-fluid atomization process. As will be shown below, use of ultrasound in two-fluid atomization, without the advantageous use of resonance according to the present invention, results in an unacceptably broad range of droplets sizes. The fundamental and at least one harmonic wavelength generated by the ultrasonic atomizer, without intervention of impinging gas-generated waves in the liquid stream, each have enough amplitude to cause droplet formation independent of the other. The prior art devices thus generate overall droplet size distribution that is a combination of the contribution of the droplets from the fundamental and at least one harmonic wavelength. The present inventor has discovered herein a method of resonance that suppresses the expression of droplets from substantially all the wavelengths generated by the ultrasonic atomizer except one of those wavelengths and has therefore narrowed the range of droplet size distribution, reduced the average droplet size, and cut the energy needed by the ultrasonic atomizer to achieve those objects. The present invention removes the prior art limitation of high energy input to use ultrasonic atomizers in two-fluid atomization, since the impinging gas is now an important additional source of atomization energy. It is evidence of resonance according to the present invention that the above described advantages of the present invention occur where for prior art devices they have not.

Figure 12A:
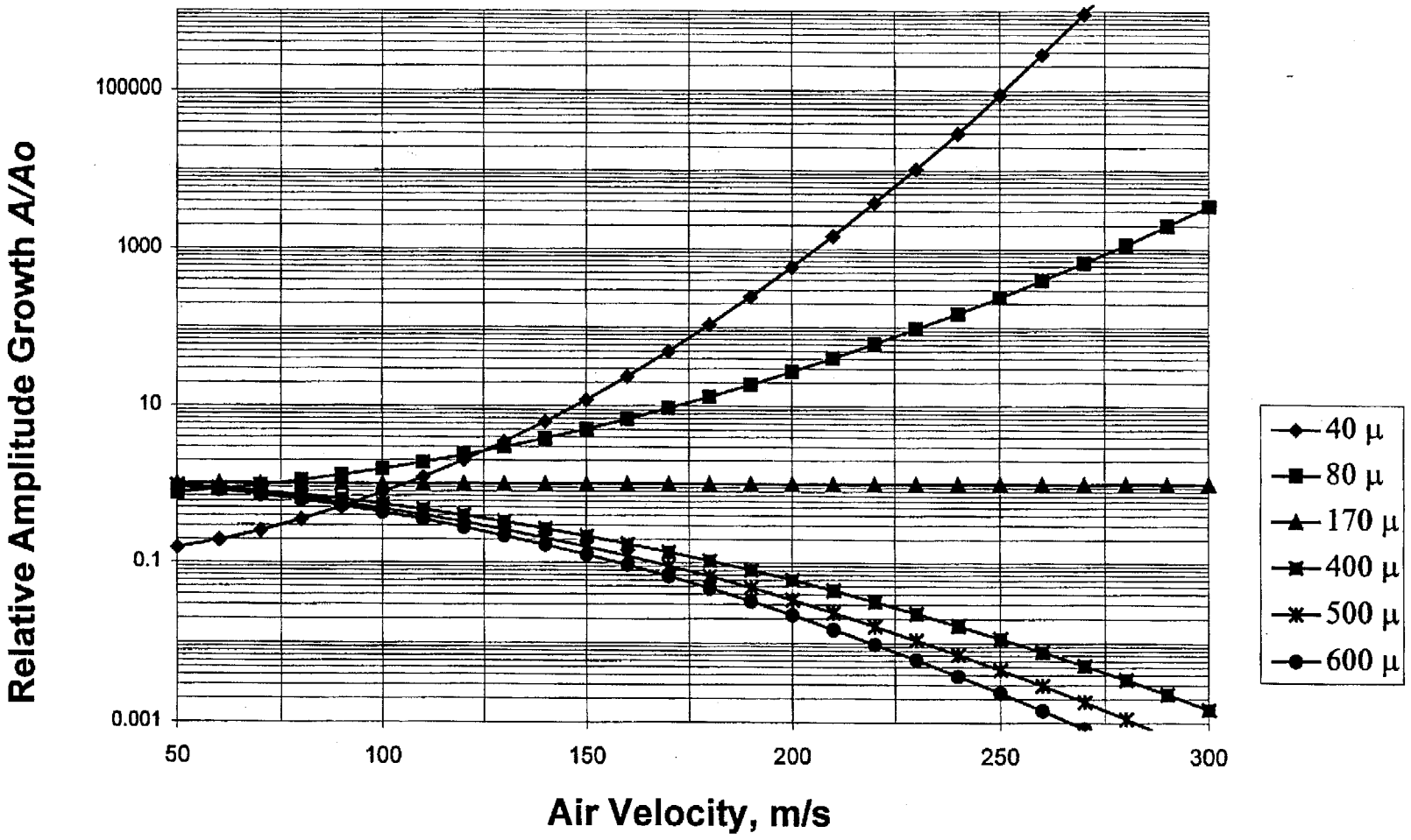
Figure 12B:
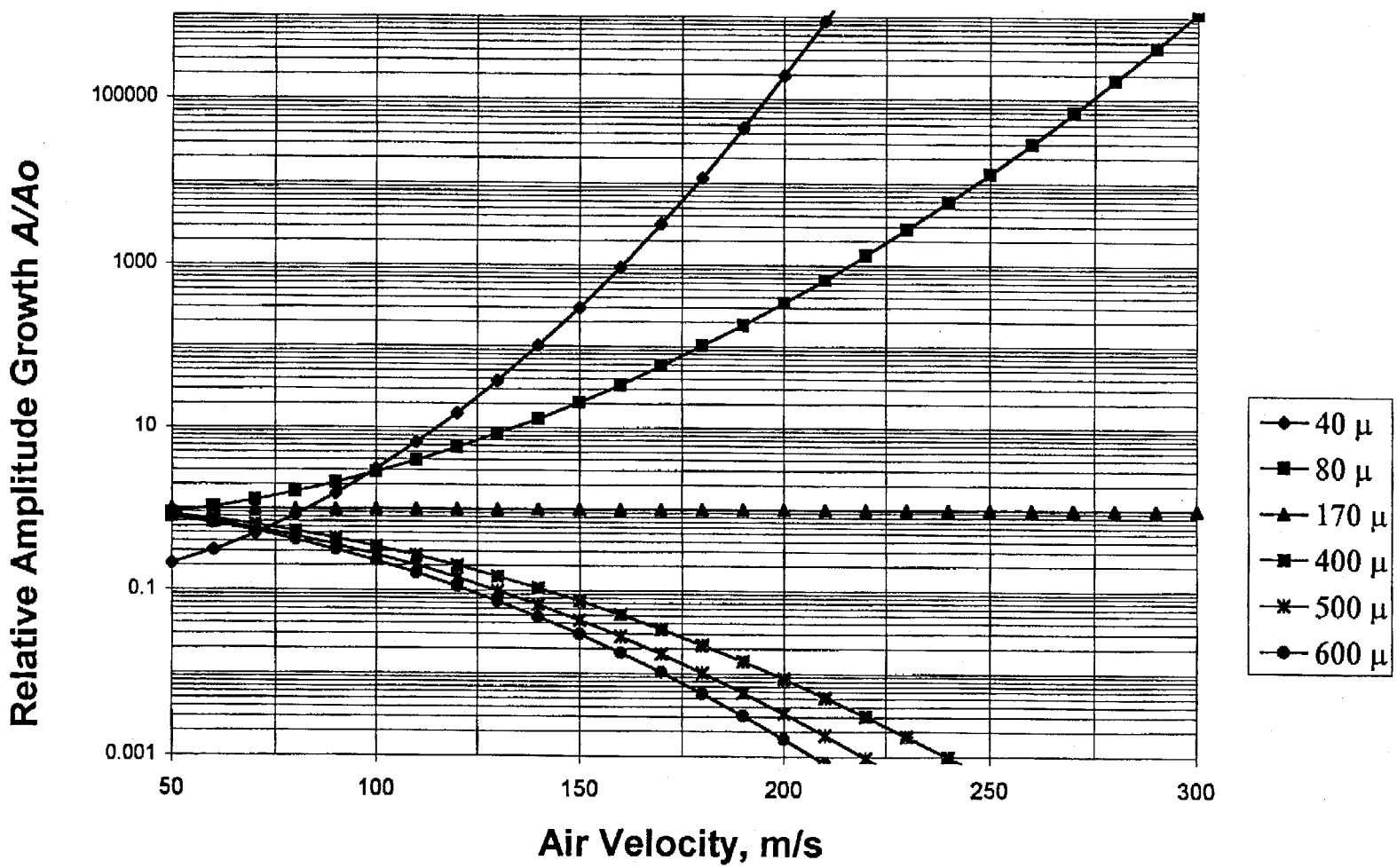

Top: nozzle position 380 μm above the optimum value, and (b) Bottom: 95–380 μm below the optimum value FIG. 12 Temporal relative amplitude growths of capillary waves as a function of air velocity at atomization time of 50 μs and surface tension of 70 dyne/cm with the Jeffrey's sheltering parameter β of 0.3 and 0.5

Figure 13A:
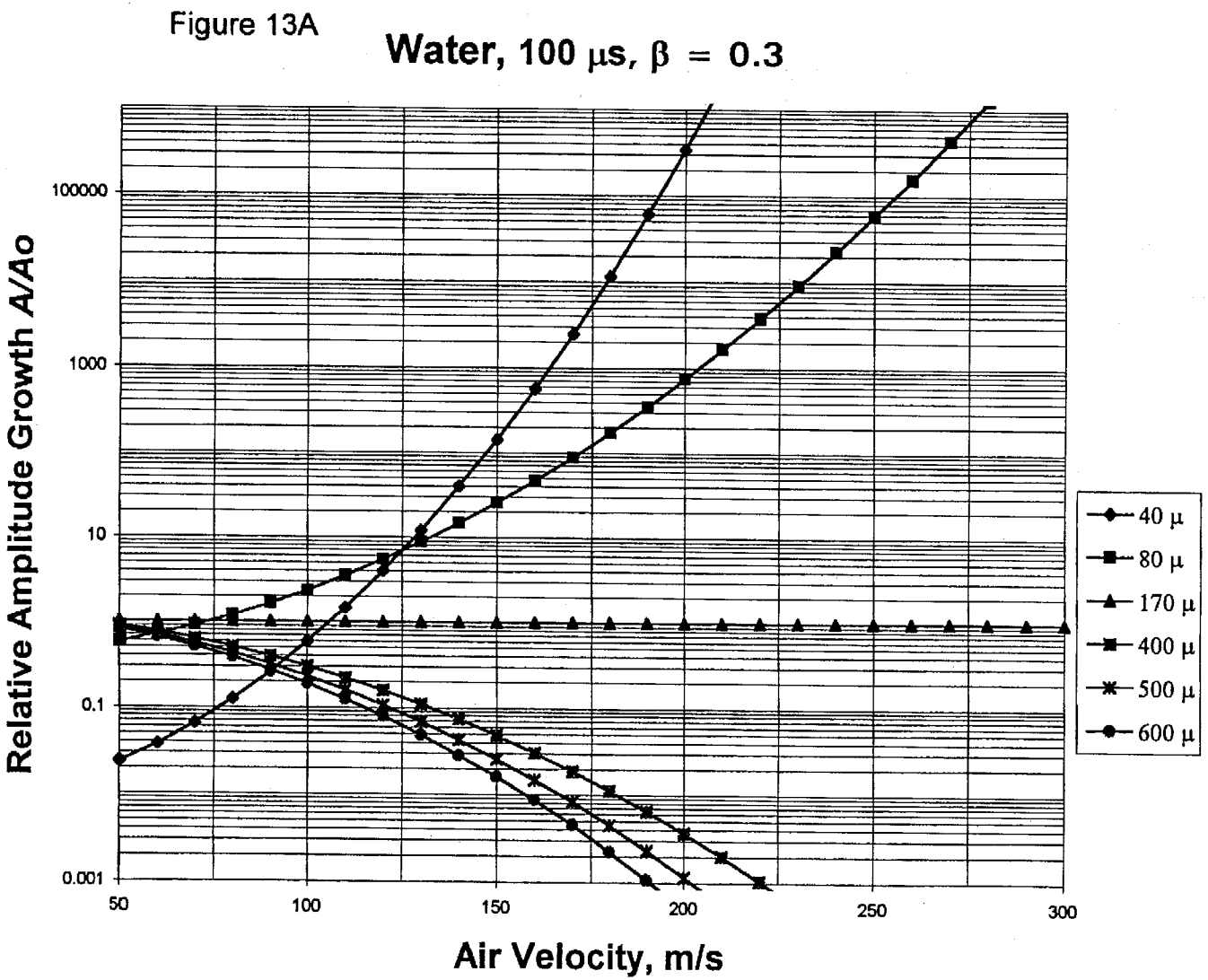
Figure 13B:
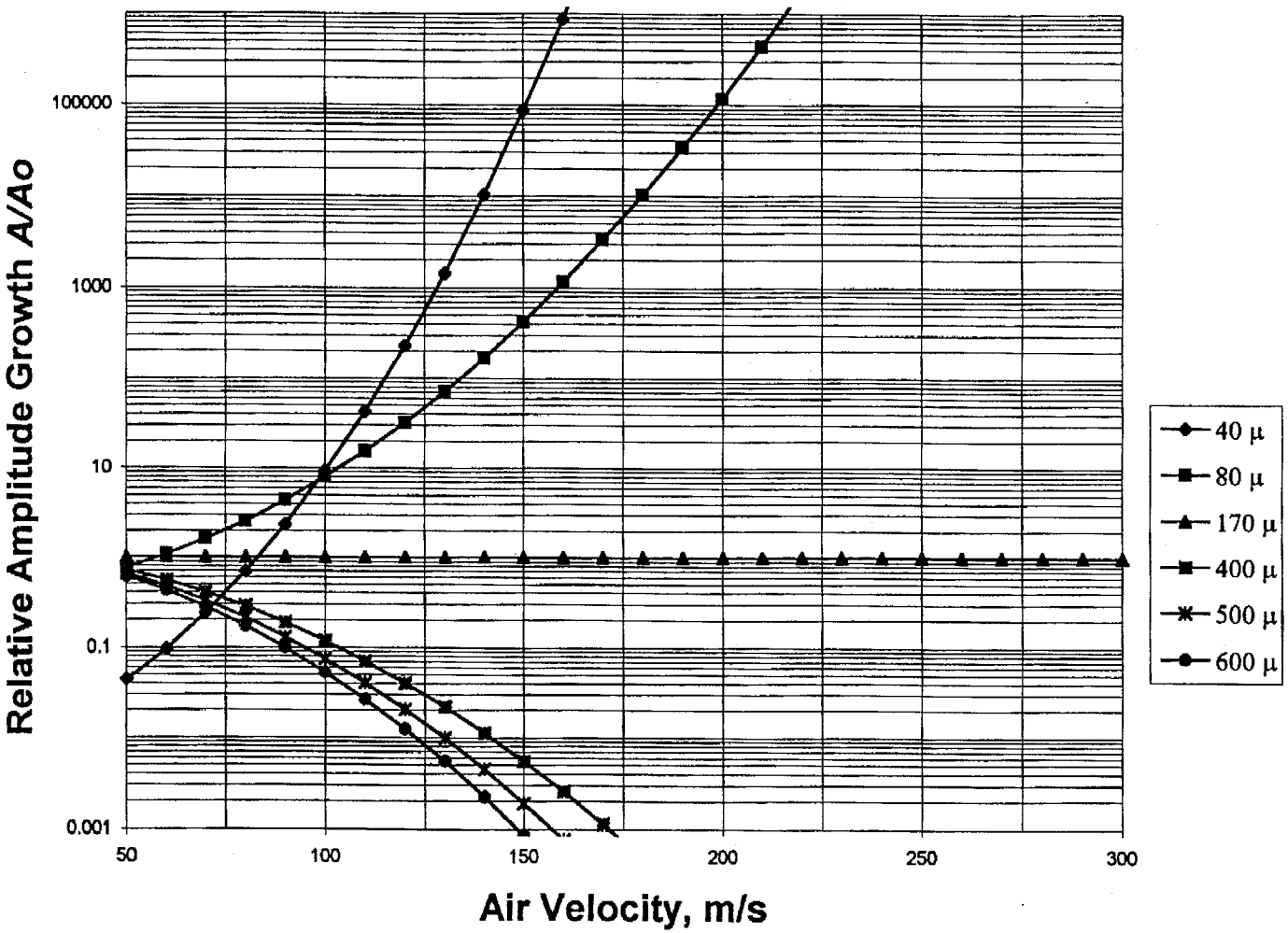

FIG. 13 Temporal relative amplitude growths of capillary waves as a function of air velocity at atomization time of 100 μs and surface tension of 70 dyne/cm with the Jeffrey's sheltering parameter β of 0.3 and 0.5

Figure 1:
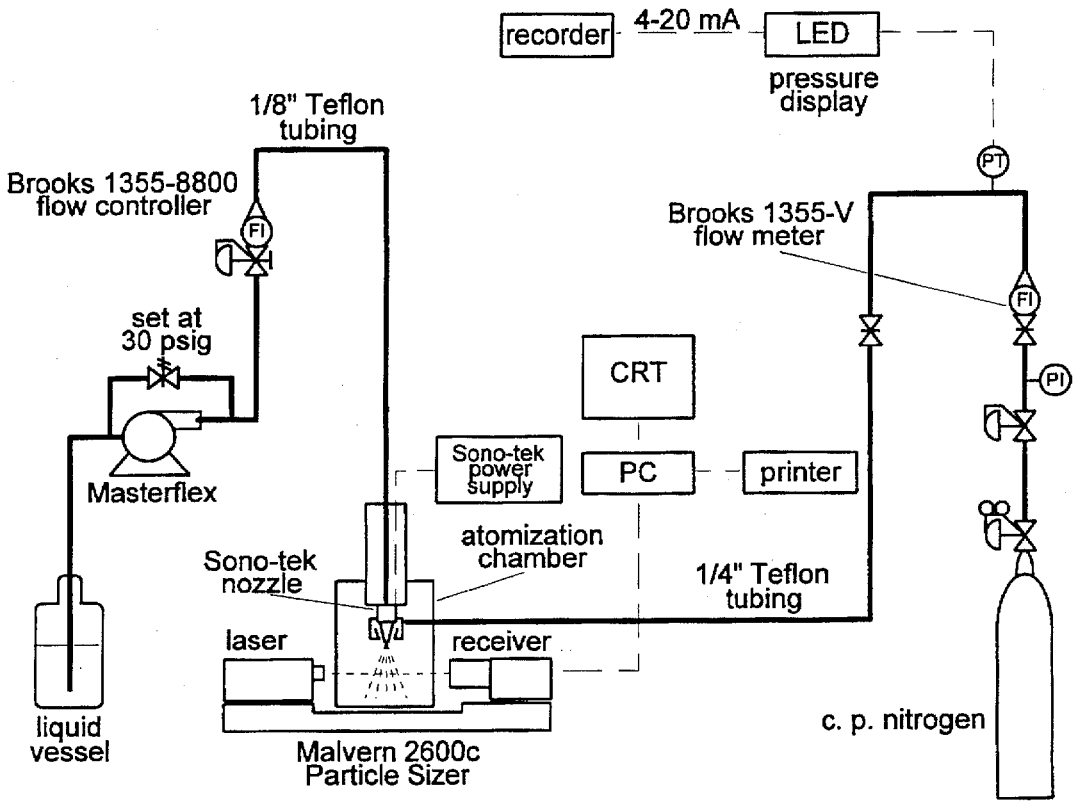
FIG. 1 Schematic diagram of the bench-scale atomization setup
Figure 14:
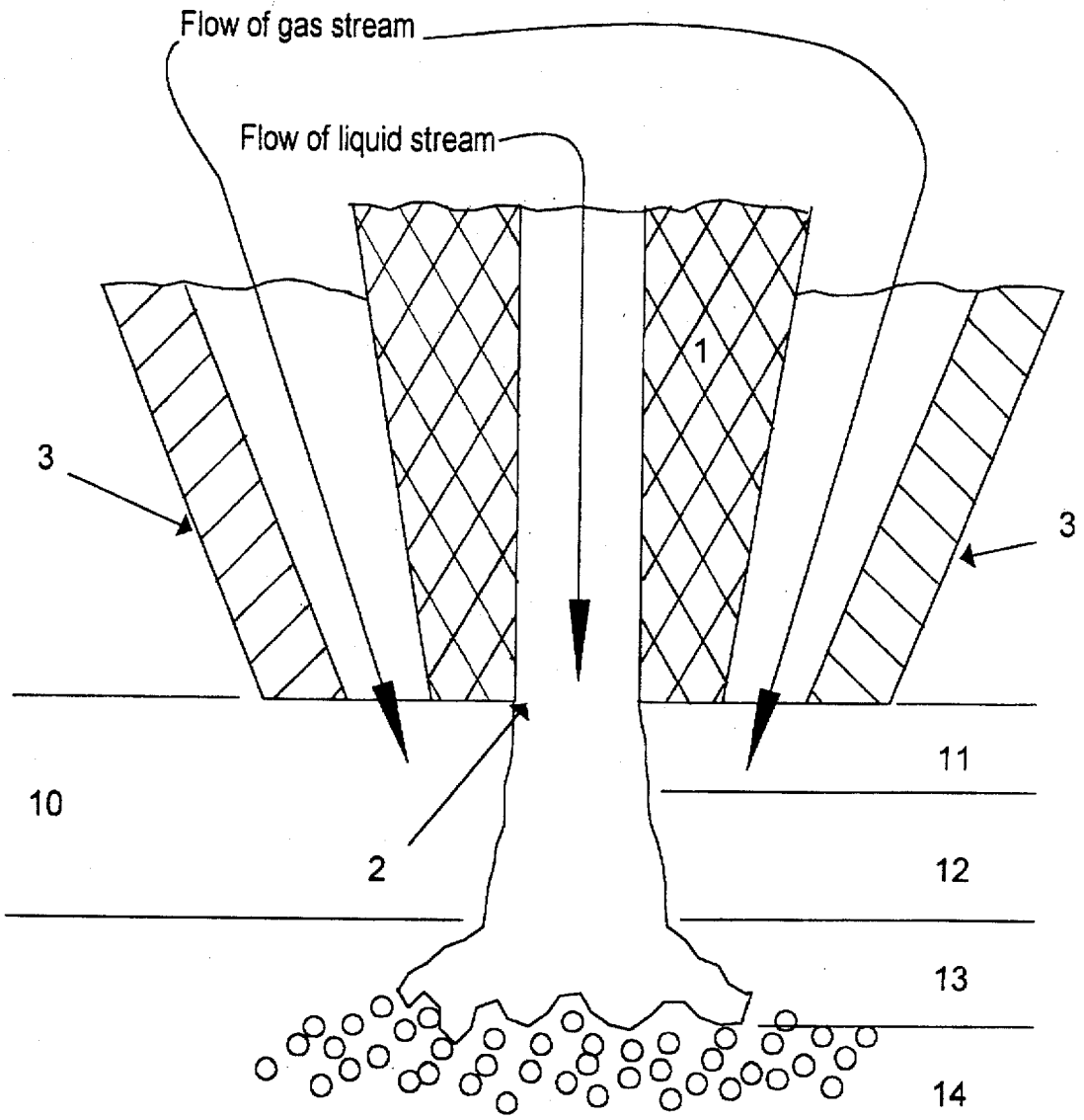

FIG. 14 Magnified section of the apparatus in FIG. 1. The nozzle is shown in greater detail disposed in channel means for channeling the impinging gas and modulating its velocity.

DETAILED DESCRIPTION OF THE INVENTION

A schematic diagram of the bench-scale atomization unit is shown in FIG. 1. Major components of the unit include an atomization chamber, a coaxial two-fluid atomizer, Brooks precision rotameters for accurate flow rate measurement, and a Malvern Particle Sizer 2600c for spray size analysis. The atomization chamber measures 35.5 cm×35.5 cm×64 cm. The coaxial two-fluid atomizer is located at the center of the atomization chamber as shown in FIG. 1. It consists of a Sono-Tek ultrasonic atomizing nozzle Model 8700 and an annulus which allows air blowing around the liquid jet as it exits the nozzle tip in a manner similar to an externally-mixed two-fluid atomizer. The distance between the nozzle tip and the laser beam for drop size measurement was varied from 2.3 cm to 16.5 cm, but was set at 13.5 cm unless otherwise described below.

Figure 2:
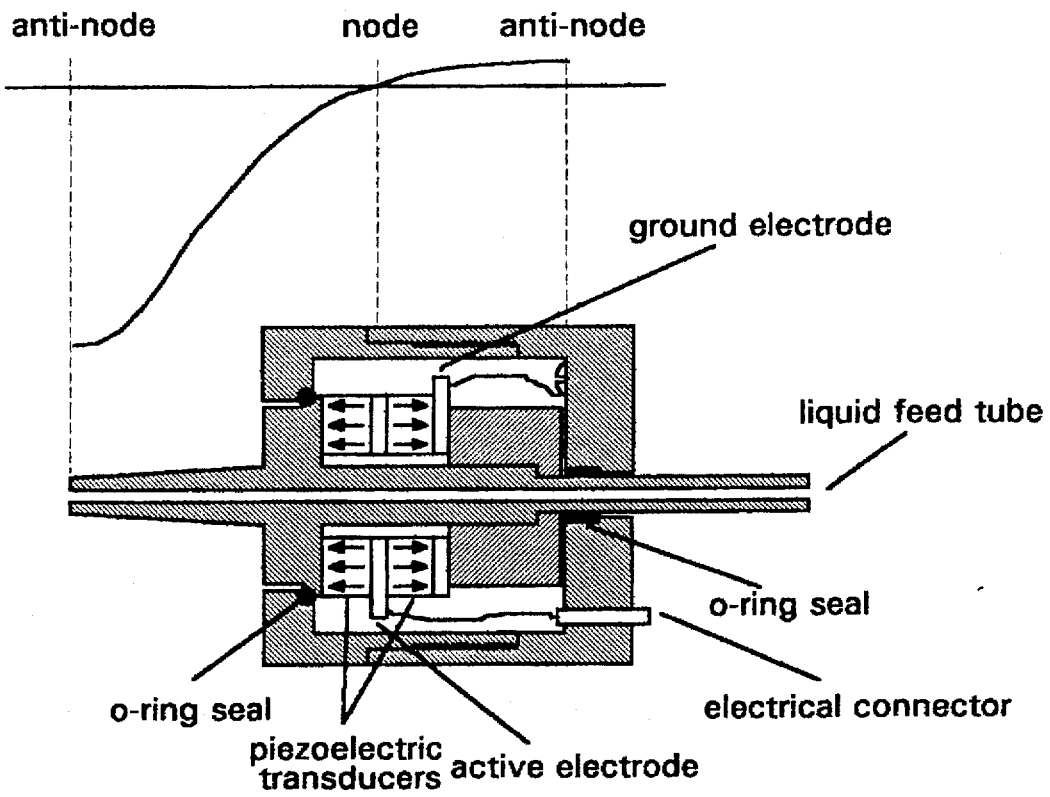
FIG. 2 Configuration of the Sono-Tek ultrasonic atomizing nozzle
Figure 3:
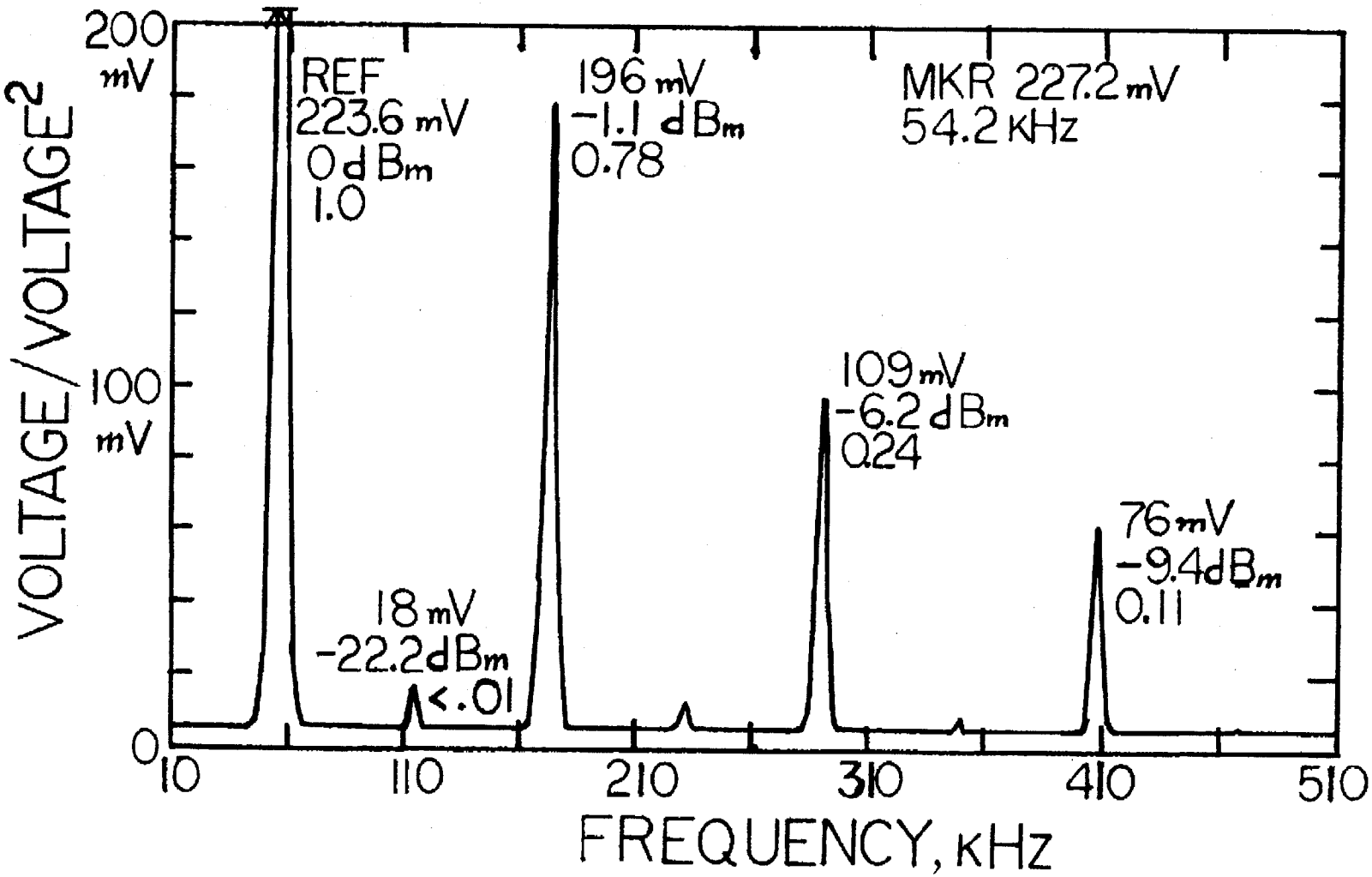
FIG. 3 Frequency spectrum of the input power signal of the Sono-Tek ultrasonic atomizing system FIG. 4 Atomization of a water jet at a velocity of 3±0.5 (1.3 cc/min) by ultrasound alone FIG. 5 (a) Top: atomization of a water jet at a velocity of 12±2 cm/s (5.1 cc/min water flow rate) by ultrasound alone (b) Bottom: atomization of a water jet at a velocity of 42±2 cm/s (17.3 cc/min water flow rate) by ultrasound alone FIG. 6 (a) Top: two-fluid atomization of a water jet at a velocity of 12±2 cm/s (5.1 cc/min water flow rate) and 160 m/s air velocity (b) Bottom: ultrasound-modulated two-fluid atomization of a water jet at a velocity of 12±2 cm/s (5.1 cc/min water flow rate), 150–160 m/s air velocity, and 1.8 watts ultrasound power input FIG. 7 (a) Top: two-fluid atomization of a water jet at a velocity of 12±2 cm/s (5.1 cc/min water flow rate) and 80 m/s air velocity (b) Bottom: ultrasound-modulated two-fluid atomization of a water jet at a velocity of 12±2 cm/s (5.1 cc/min water flow rate), 80 m/s air velocity, and 1.8 watts ultrasound power input FIG. 8 (a) Top: two-fluid atomization of a water jet at a velocity of 42±2 cm/s (water flow rates of 17.3 cc/min), air velocities of 100±20 and 250±20 m/s and a nozzle-to-beam distance of 13.5 cm (b) Bottom: ultrasound-modulated two-fluid atomization of a water jet at water velocities of 42±2 and 12±2 cm/s (water flow rates of 17.3 and 5.1 cc/min ), an air velocity of 250±20 m/s, ultrasound input power levels of 1.8 and 2.5 watts, and a nozzle-to-beam distance of 13.5 cm FIG. 9 Effects of ultrasound input power on the drop size distribution of ultrasound-modulated two-fluid atomization of a water jet at a velocity of 12±2 cm/s (5.1 cc/min water flow rate) and 150–160 m/s air velocity FIG. 10 Ultrasound-modulated two-fluid atomization of a water jet at a water velocity of 42±2 (17.3 cc/min water flow rate), an air velocity of 100±20 m/s, ultrasound input power levels of 1.8 watts, and a nozzle-to-beam distance of 13.5 cm FIG. 11 Ultrasound-modulated two-fluid atomization of a water jet at a water velocity of 42±2 cm/s (17.3 cc/min water flow rate), an air velocity of 250±20 m/s, an ultrasound input power of 2.5 watts, and a nozzle-to-beam distance of 13.5 cm at (a)

The Sono-Tek ultrasonic nozzle as shown in FIG. 2 consists of a pair of washer-shaped ceramic piezoelectric transducers sandwiched between two titanium cylinders located in the large diameter (about 3.6 cm) of the nozzle body. Two O-rings serve to isolate the nozzle from the external housing. The piezoelectric transducers receive electrical input in the form of a high-frequency signal from a power supply Model PS-88 and convert the input electrical energy into mechanical energy of vibration. The nozzle is geometrically configured such that excitation of the piezoelectric transducers creates a standing wave through the nozzle with maximum vibration amplitude occurring at the nozzle tip (orifice diameter of 0.93±0.02 mm) and a node at the fixed joint of the piezoelectric transducers as shown in FIG. 2. The ultrasonic energy originating from the transducers undergoes a step transition and amplification as the standing wave transverses the length of the nozzle. The input electric power to the piezoelectric transducers can be varied from zero to 10 watts as measured by a power meter. The fundamental (first harmonic) frequency of the input signal to the piezoelectric transducers in the Sono-Tek ultrasonic nozzle is 58 kHz as measured by a Hewlett Packard Spectrum Analyzer Model 8562A. As shown in FIG. 3, the power of the third harmonic with a frequency of 174 kHz with respect to that of the fundamental is 0.78 or −1.1 $dB_m$, i.e. $-10\times\log_{10}(0.78)$. The fifth and the seventh harmonics also exist but to a much lesser degree. The even harmonics are negligible as shown in FIG. 3 because of the boundary condition (one end free and the other fixed) of the piezoelectric transducers. Note that the vertical scale in FIG. 3 is linear in mV only.

A steady liquid flow rate is maintained by a diaphragm-type Brooks Flow Controller Model 8800 which is an integral part of the precision rotameter for liquid flow rate measurement. Two constant water flow rates of 17.3 and 5.1 $cm^3$/min, equivalent to liquid velocities of 42±2 and 12±2 cm/s, were used in this study. Water flow rates as low as 1.3 cc/min were also used in atomization by ultrasound alone in order to establish the relationship between the input of energy in the ultrasonic frequency range and the mean drop size resulting from such input. Constant air flow rates ranging from 28.6 to 7.2 standard liter/min provided apparent air velocities between the nozzle and the annulus (channel means) ranging from 250±30 to 80±5 m/s. The uncertainty in air velocity is due to difficulty in measurement of the annular cross sectional area for air flow. The actual velocity of the air flow moving in the same direction as the surface of the liquid stream issuing from the nozzle is inferred by calculation as described below for generation of liquid waves at the surface of the liquid stream issuing from the nozzle.

The atomized drop size and size distribution is measured using the Malvern Particle Sizer and is presented in the attached figures as frequency plots of drop diameters (Model Independent). The Malvern Particle Sizer measures the drop size and size distribution of the spray through diffractive scattering (Fraunhoffer diffraction) of laser light. The frequency plot is volume-based, but the number-based mean diameter, NMD, is also calculated and presented by the software available as part of the Malvern Particle Sizer. Therefore, if such a relationship arises in the course of testing, the relationship between NMD and the peak diameter of the frequency plot can be detected from single-peak (monodisperse) drop size distributions. The Malvern Particle Sizer is calibrated using known particle size and size distribution standards provided by Advanced Particle Measurement, California. The uncertainty in drop size measurement is ±5%. For example, the standard deviation of the volume-mean diameters of the drop size distributions in ultrasound-modulated two-fluid atomization is ±2 μm. Excellent reproducibility has been obtained as shown by the open and solid data points of duplicate experiments in the frequency plots in the attached figures.

When air blows along a liquid stream or jet, waves form on the stream or jet surface. The amplitude (A) of these surface waves is described by the following differential equation:

$$\frac{\delta A}{\delta t} = A\left[\frac{\pi\beta\rho_A(V_A-u)^2}{\lambda\rho u} - \frac{8\pi^2\eta}{\rho\lambda^2}\right] = A\zeta \tag{1}$$

where λ, μ, ρ, $\rho_A$, and β are wavelength, wave velocity, liquid density, air density, and Jefferey's sheltering parameter (a numerical value ranging from 0 to 1 which represents the fraction of waves exposed to wind), respectively. Eq. (1) was derived for viscous liquids with viscosity η from the equations of continuity and motion with two assumptions: (1) the tangential stress is zero at the air-water interface and (2) the pressure of the wind with a relative velocity $V_A-\mu$ on the advancing wave-profile roughly equals $\beta\rho_A(V_A-\mu)^2\delta A/\delta z$, where z-axis is the direction of wind blow parallel to the jet axis. These waves are standing waves with the amplitude proportional to $e^{\zeta\cdot t}\cos(2\pi z/\lambda)$. The amplitude at a fixed z grows exponentially with time when $V_A$ exceeds the minimum values determined by setting $\delta A/\delta t=0$, i.e. $\zeta=0$.

From Eq. (1), the amplitude which is damped by the liquid viscous force increases as the relative air velocity $(V_A-\mu)$ increases. When both the aerodynamic pressure and the surface tension (σ) are significant, the wave velocity u is given by:

$$u = \left[\frac{\lambda a}{2\pi} + \frac{2\pi\sigma}{\lambda\rho}\right]^{1/2} \tag{2}$$

where the acceleration (α) is caused by the aerodynamic drag on the liquid jet. The first term, due to acceleration waves, is neglected in comparison with the second term, due to capillary waves, for pertinent λ's under investigation. At an air velocity of 250 m/s, the first term is less than one fifth of the second term for water waves with λ's smaller than 100 μm. This is also true for water waves with λ's smaller than 250 μm at an air velocity of 100 m/s.

When in resonance, λ of the air-generated waves equals the wavelength $\lambda_C$ of the capillary waves generated on a liquid jet or stream vibrating at an ultrasonic frequency ($f$ in cps or Hz) in accordance with the Kelvin equation:

$$\lambda_c = \left[ \frac{2\pi\sigma}{\rho f^2} \right]^{1/3} \quad (3)$$

with a wave velocity $\mu$ equaling $(2\pi\sigma/\lambda_c\rho)^{1/2}$. Note that a liquid jet issuing from an ultrasonic nozzle such as the Sono-Tek atomizing nozzle is thus shown to have the ability to maintain wave motion in the ultrasound frequency. When the capillary waves generated on the vibrating liquid jet are in resonance with the waves generated by the blowing air, energy is transferred from the air to the liquid jet. As a result, the amplitude of the liquid capillary waves grows exponentially with time, i.e. $A=A_o e^{\zeta t}$ as obtained by integration of Eq. (1), when $V_A$ exceeds the minimum values. These minimum air velocities for capillary waves with wavelengths longer than 40 μm are equal to or less than 75 m/s as shown in Table I below. Atomization occurs when the wave amplitude is too great to maintain wave stability.

Based on the aforementioned resonance theory, ultrasound can be used to generate capillary waves of wavelengths determined by its frequency and thus, control the drop size of two-fluid atomization.

According to a preferred embodiment of the present invention and substantially shown in FIGS. 1 and 2, atomization of water jet was first carried out at water flow rates of 1.3, 5.1, and 17.3 cc/min using ultrasound alone to ensure that the Sono-Tek ultrasound nozzle system was indeed functional. At input power levels above minimum values, soft sprays with a round top were seen to start immediately at the nozzle tip. The minimum power levels required to sustain stable ultrasonic atomization varied with water flow rates: 1.0, 1.8, and 1.9 watts for 1.3, 5.1, and 17.3 cc/min, respectively. Power levels up to 3.5 watts had no significant effect on the resulting drop size distribution.

Figure 4:
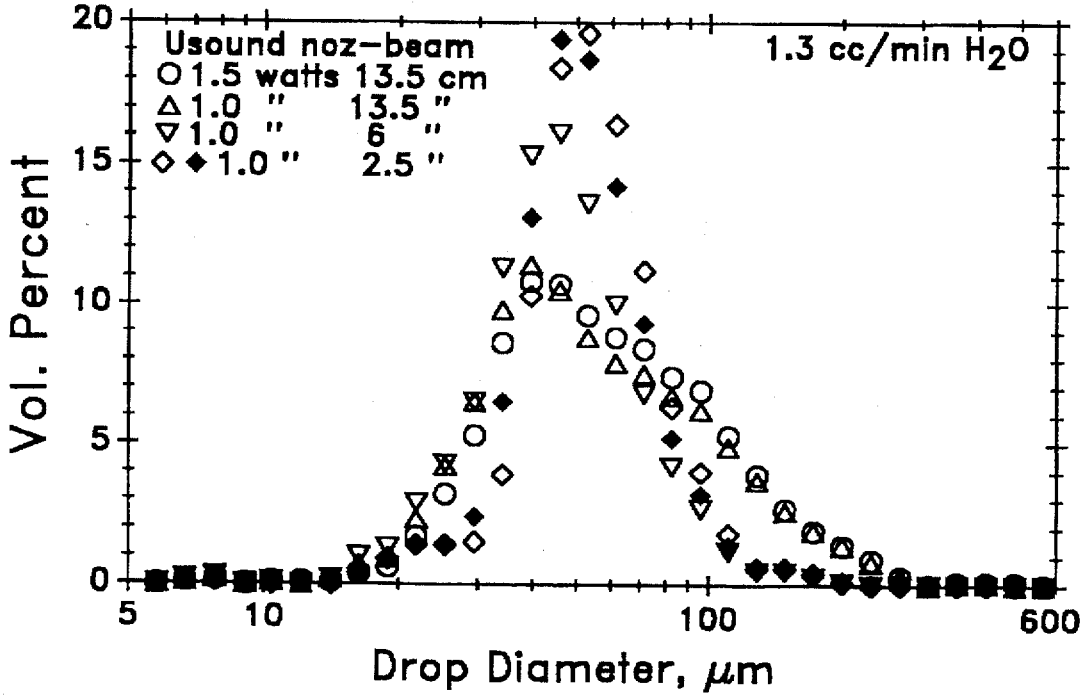

As shown in FIG. 4, the drop size distribution obtained at a water flow rate of 1.3 cc/min and a distance of 2.5 cm between the nozzle tip and the laser beam for drop size measurement has a peak frequency at a drop diameter of 50 μm. The corresponding volume mean diameter (VMD) is 50±2 μm number mean diameter (NMD) is 36±2 μm, which is somewhat larger than a reported result of number median diameter of 29 μm obtained at 12 cc/min water rate. This discrepancy may be attributed to the differences between the number mean (NMD) and the number median diameter. The drop size distribution degenerates into two peaks: a primary peak at 40 μm drop diameter and a shoulder at 85 μm as the nozzle-to-beam distance increases to 13.5 cm.

Figure 5A:
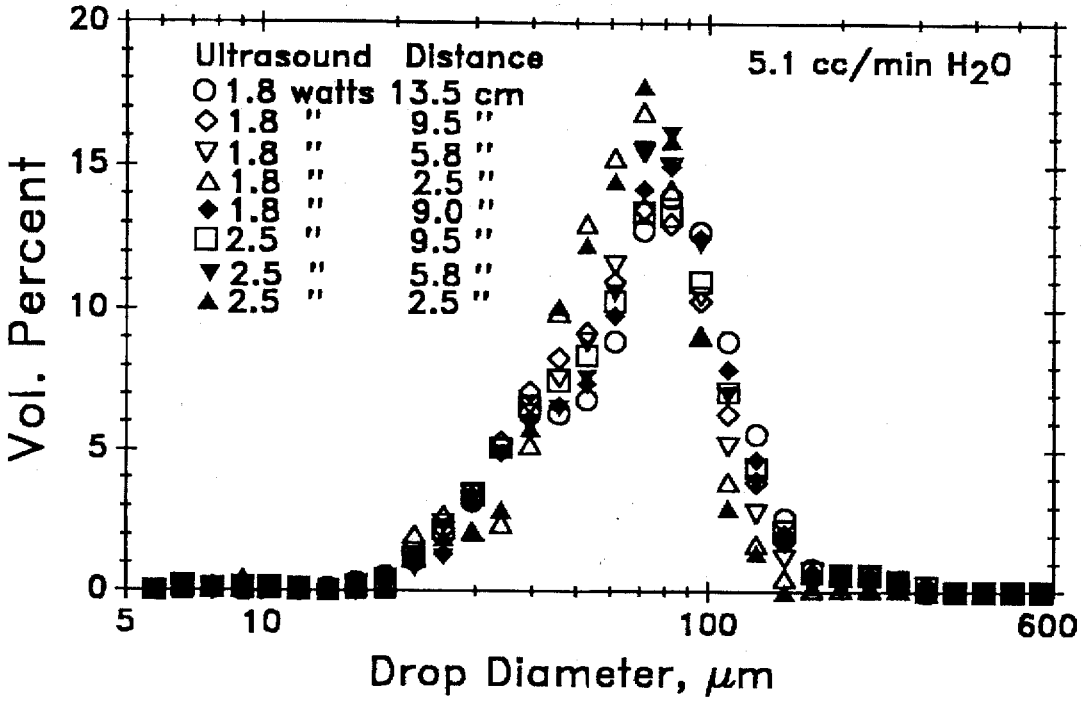
Figure 5B:
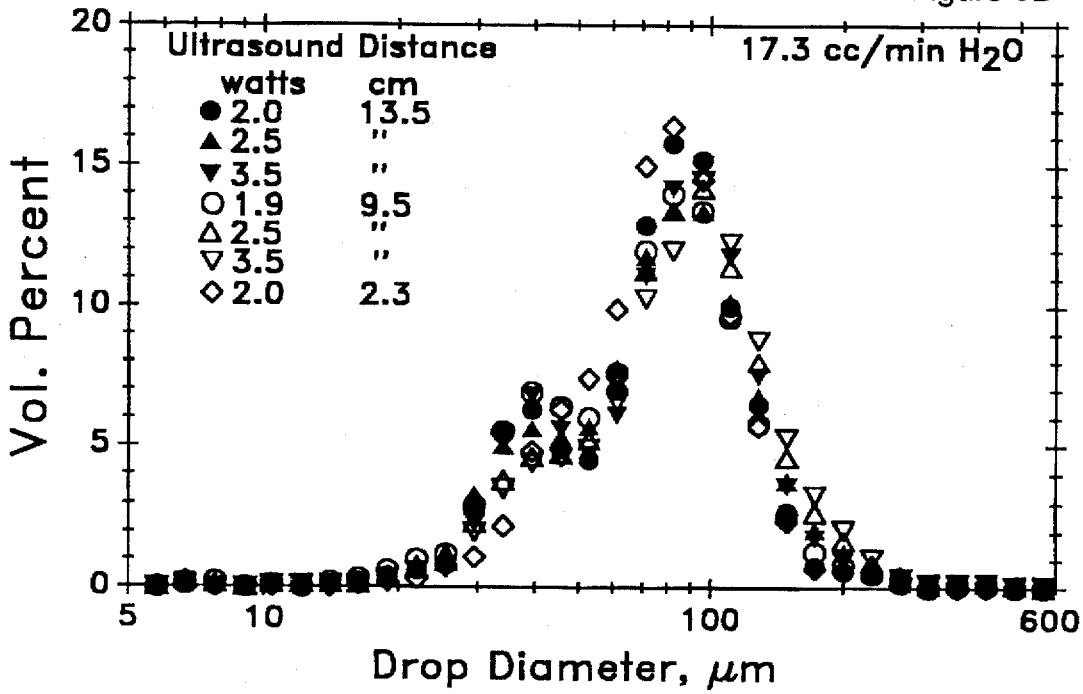

FIG. 5 shows that as the water flow rate increases to 5.1 cc/min, the drop size distribution measured at a nozzle-to-beam distance of 2.5 cm shows a dominate peak at 70 μm drop diameter (VMD of 61±2 μm and NMD 41±2 μm). It degenerates into a primary peak at 80 μm and a shoulder at 40 μm as the nozzle-to-beam distance increases to 13.5 cm; further increase in the nozzle-to-beam distance from 13.5 to 16.5 cm has no significant effect on the drop size distribution. Also shown in FIG. 5 is that the shoulder at 40 μm becomes more distinct and the primary peak shifts from 80 μm to 85 μm as the water flow rate increases to 17.3 cc/min. The drop size distribution is also independent of the nozzle-to-beam distance ranging from 9.5 to 16.5 cm.

The two peaks of the aforementioned drop size distributions can be attributed to breakup of the capillary waves generated by the first harmonic (58 kHz) frequency and the third harmonic (174 kHz) frequency of the ultrasound based on the Kelvin Equation. The frequency ratio of the capillary waves which break up to form drop size distributions with 40 μm and 85 μm peak diameters equals $(85/40)^{3/2} \approx 3$. No third peak is seen in the drop size distributions in spite of the presence of the fifth and seventh harmonics in the ultrasound input power as shown in FIG. 3. This is not surprising in view of the much lower power levels of these higher harmonics and the higher surface energy required to be transferred to the liquid stream to produce drops smaller than 30 μm in diameter.

Figure 6A:
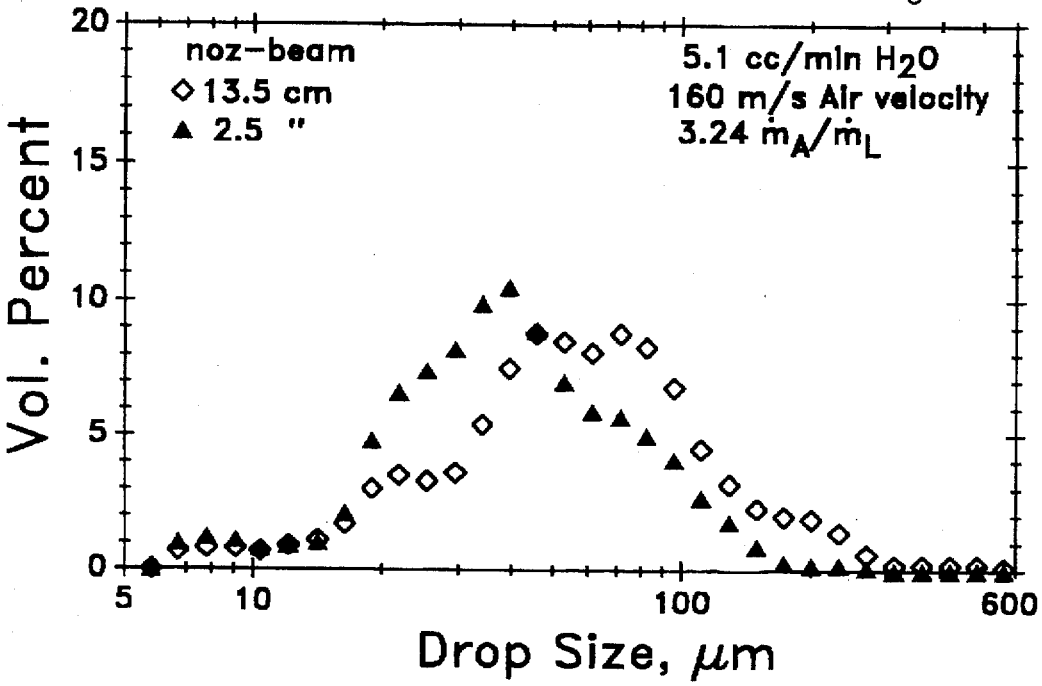
Figure 7A:
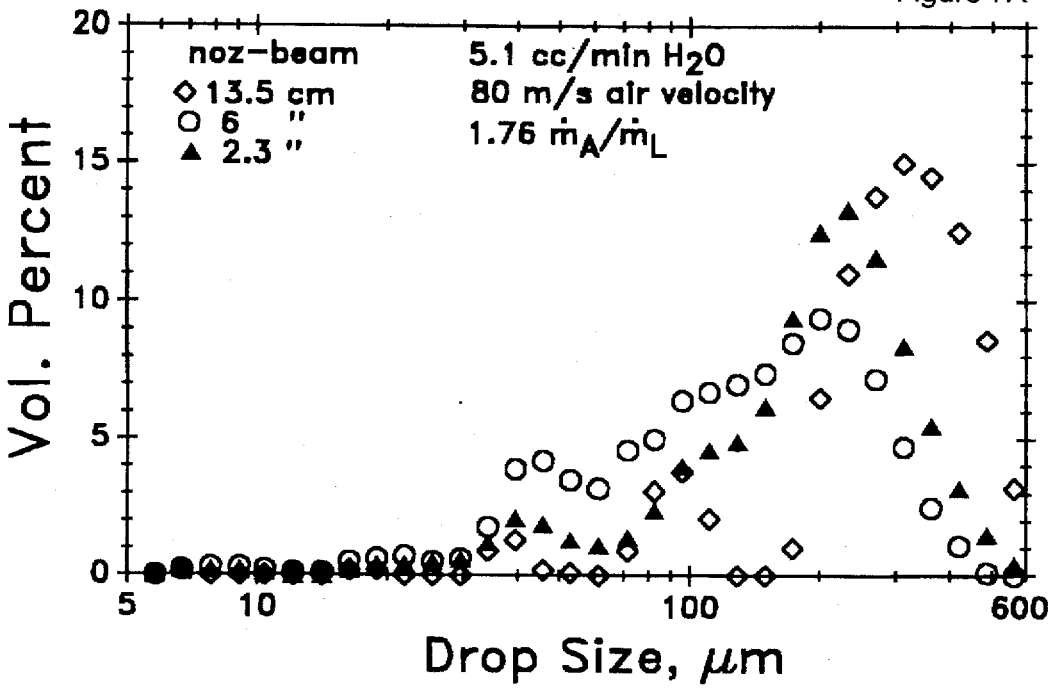

When a water jet was atomized by air alone (called two-fluid atomization), very broad drop size distributions with sharp cone-shape sprays were obtained. The drop size distribution varied substantially with the nozzle-to-beam distance. Specifically, as shown in FIGS. 6*a* and 7*a*, the drop size distribution shifts to the larger drop diameters as the nozzle-to-beam distance increases from 2.5 to 13.5 cm. This finding is different from the aforementioned result of ultrasonic atomization which is independent of the nozzle-to-beam distance ranging from 6 to 13.5 cm and only changes slightly as the distance varies from 2.5 to 6 cm (see FIG. 5).

A comparison of FIG. 7*a* with FIG. 6*a* shows that the drop size distribution for atomization at a water flow rate of 5.1 cc/min shifts to smaller diameters as the air velocity increases. Specifically, drops with diameters ranging from 200 to 300 μm dominate over drops with diameters smaller than 100 μm at 80 m/s air velocity. The reverse is true at 160 m/s air velocity. Similar phenomena are seen FIG. 8*a* for atomization at a higher water flow rate (17.3 cc/min) when the air velocity increases from 100±20 to 250±20 m/s.

Figure 6B:
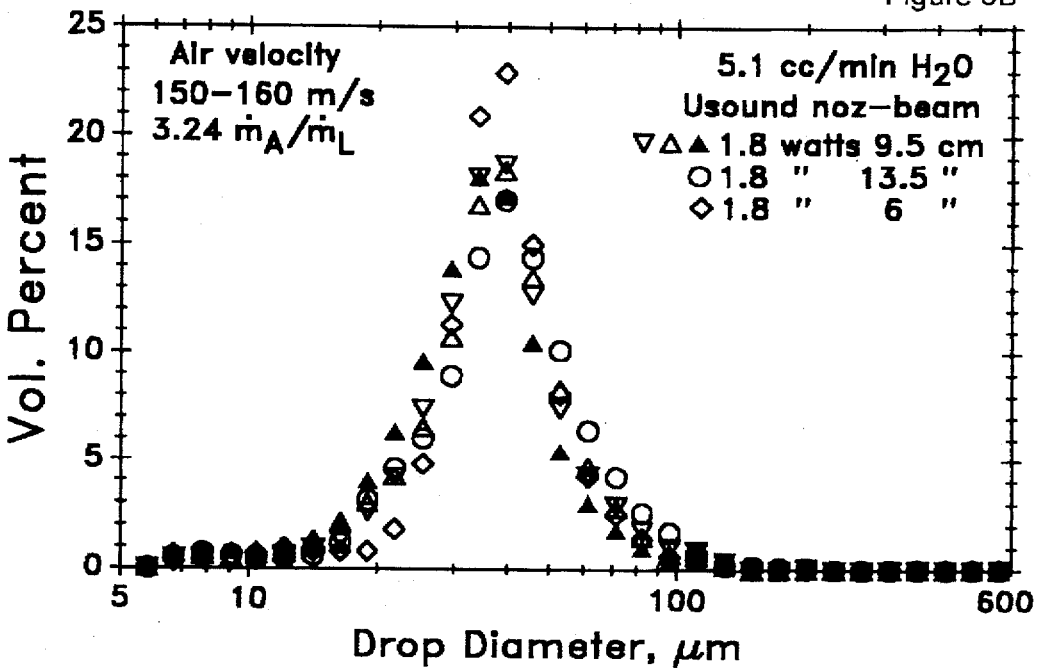
Figure 9:
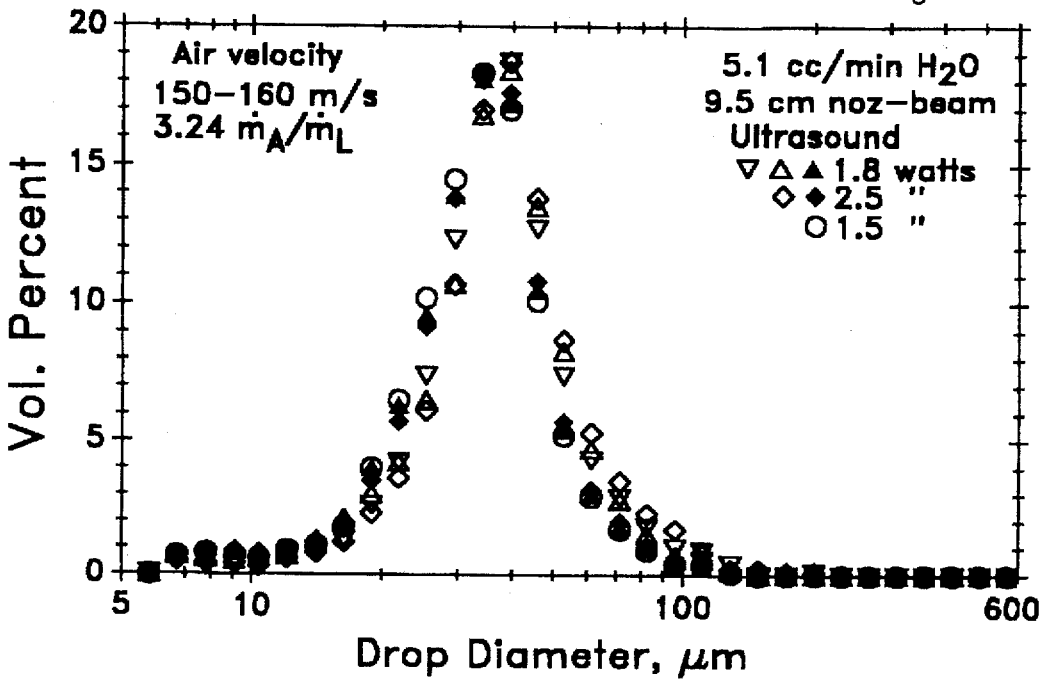

When ultrasound was used in conjunction with air according to a preferred embodiment of the invention, cone-shape sprays similar to those in two-fluid atomization were observed. However, the drop size distribution was considerably narrowed and shifted to smaller drop diameters (compare FIG. 6*b* to FIG. 6*a* and FIG. 7*b* to FIG. 7*a*). Comparisons of FIGS. 6*b* and 7*b* with FIG. 5*a* reveal that the peak frequency occurs at the drop diameter (40 μm) generated by the third harmonic of the ultrasound. Thus narrowly sized drops (half widths of 15 to 20 μm) with peak frequency at 40 μm drop diameter (VMD of 35±2 μm and NMD of 20±2 μm) can be produced when ultrasound at 1.8 watts input power is used in conjunction with air at an air velocity of 160 m/s in atomization of water at a rate of 5.1 cc/min. Since only drops resulting from one frequency are dominating, the nozzle-to-beam distance has little effect on the drop size distribution. Furthermore, FIG. 9 shows that at an air velocity of 150–160 m/s, atomization of 5.1 cc/min water occurs even at 1.5 watts, resulting in drop size distributions similar to those 1.8 and 2.5 watts. It should be noted that no atomization was observed at an water flow rate of 5.1 cc/min when ultrasound at 1.5 watts was used alone.

Figure 7B:
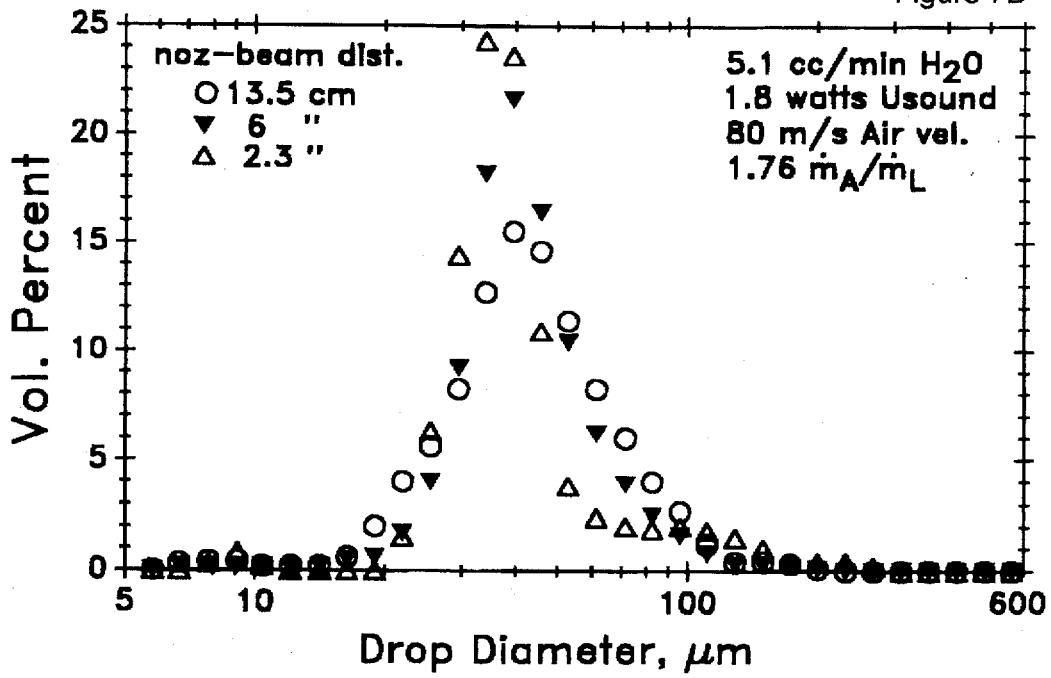

The drop size distributions are somewhat broader at 80 m/s air velocity than at 160 m/s. As shown in FIG. 7*b*, the drop distribution measured at a nozzle-to-beam distance of 2.3 cm reveals presence of some big drops with diameters larger than 100 μm.

Figure 10:
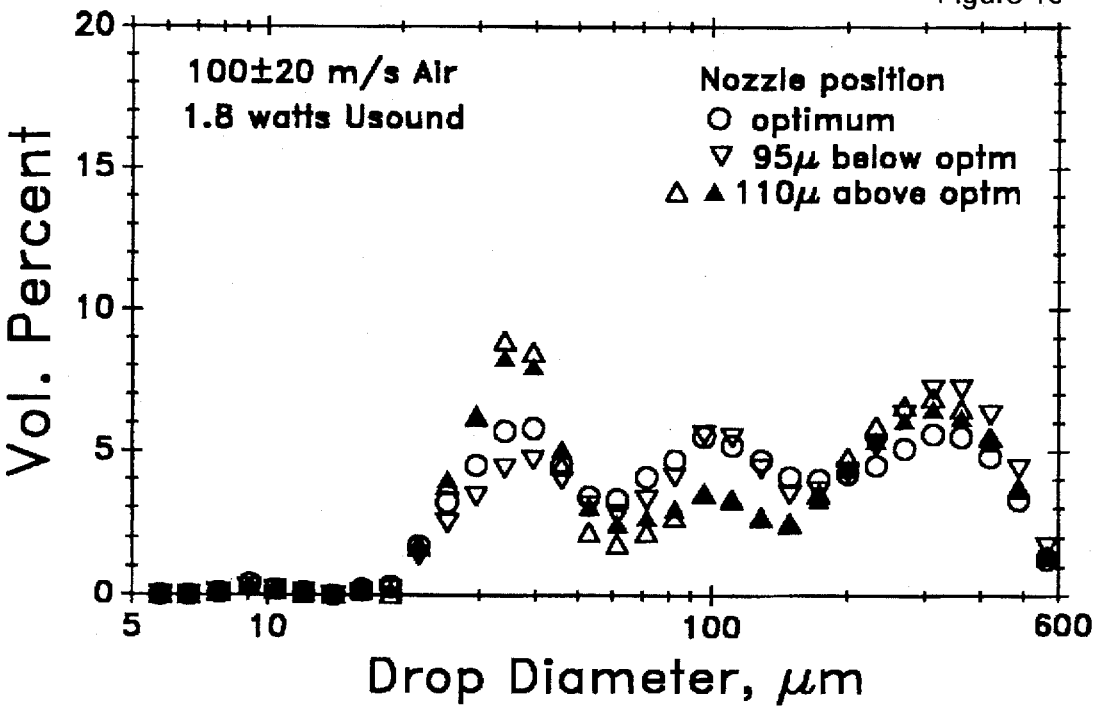
Figure 11A:
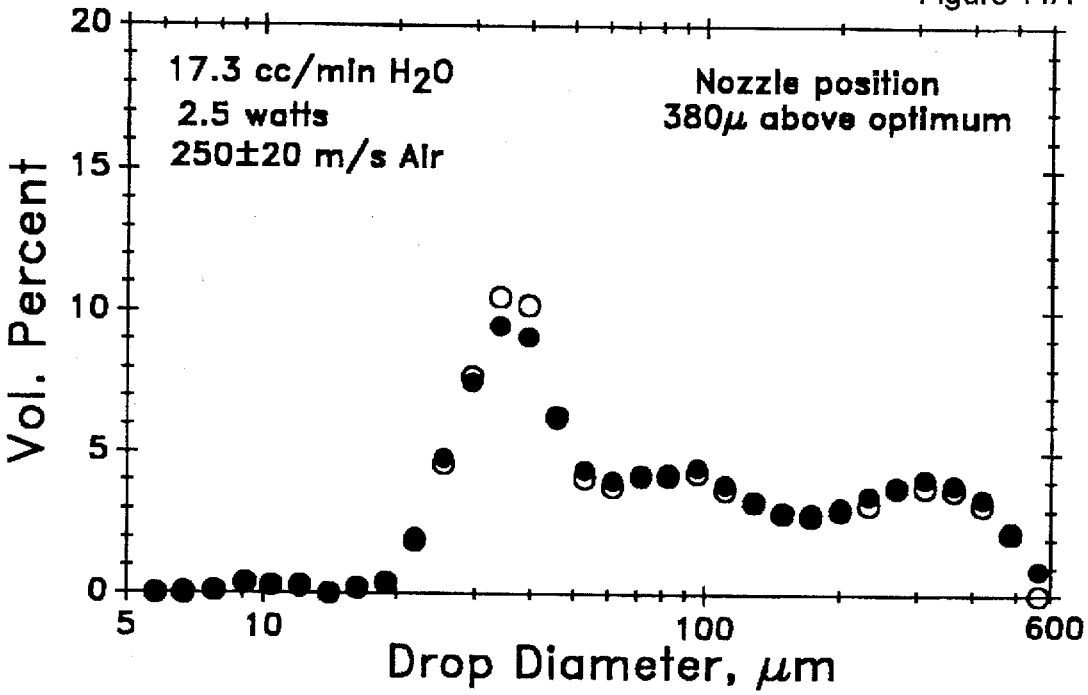
Figure 11B:
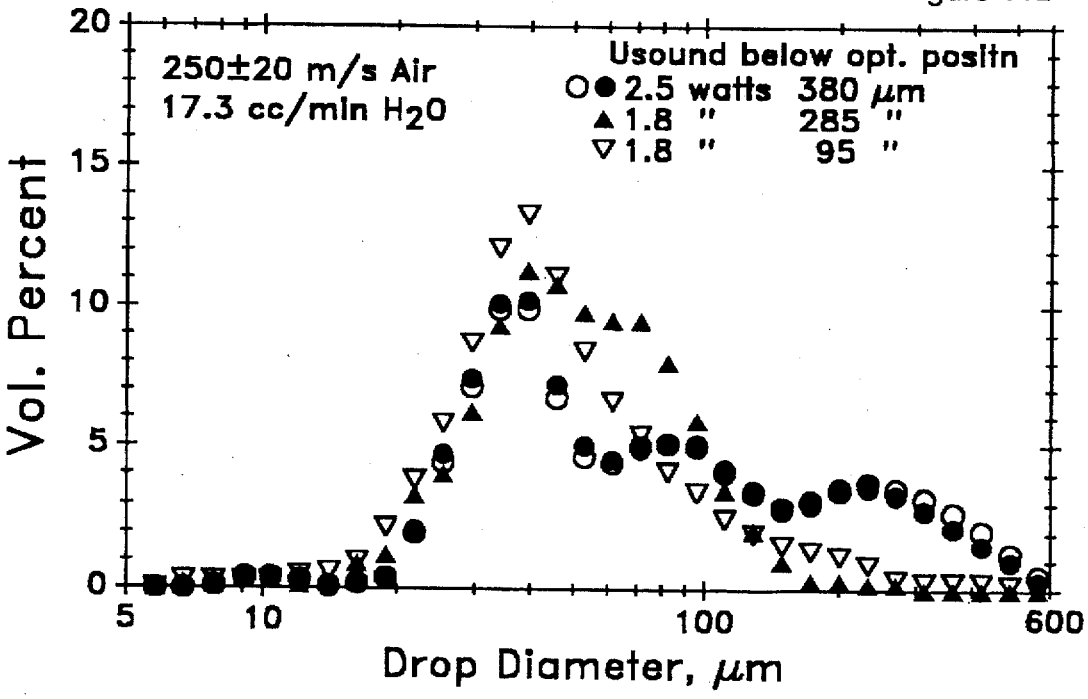

Similar results were obtained in ultrasound-modulated two-fluid atomization of water at 17.3 cc/min flow rate and ultrasound input power of 2.5 or 1.8 watts. Specifically, drop size distributions with one peak at 40 μm diameter (VMD of 44±2 μm and NMD of 28±2 μm) are seen in FIG. 8*b* for atomization at 250±20 m/s air velocity. However, as the air velocity is reduced from 250±30 to 100±20 m/s, drop size distributions with three distinct peaks at about 40 μm, 90 μm, and 300 μm are seen in FIG. 10 despite fine tuning of the nozzle position.

The predominating 40 μm peak of the drop size distribution for ultrasound-modulated two-fluid atomization is attributable to two effects: (1) resonance between the capillary waves generated by the ultrasound and those generated by the high-velocity air, and (2) a much faster amplitude growth of the capillary waves with $\lambda_C$=80 μm which break up to form 40 μm-diameter drops compared to those of longer wavelengths. As a most convincing display that the above resonance theory explained the dramatic results obtained by the present invention, the annulus (channel means) channelling the air stream around the liquid jet was moved in small increments up and down relative to the position of the nozzle at which optimum results were produced. In the case of the tests made and reported in FIG. 11, the nozzle-channel means relationship is changed to change the velocity of the air between them, the drop size distribution becomes broader at first, and additional peaks appear at 95 μm and 300 or 250 μm drop diameters as the annulus is 380 μm away from the optimum position. The new peaks at 300 μm or at 250 μm can be attributed to atomization by air alone. Thus, at relatively small displacements from the optimum nozzle-channel means relationship achieved by the present invention, the change in gas velocity over the surface of the liquid stream from the nozzle changes the wavelength of the waves generated by the gas at that surface so that resonance has been lost and drop size distributions clearly separate into composites drops formed by ultrasonic atomization and two-fluid atomization. In contrast, with resonance at an optimum position, monodisperse drop size distributions occur at the diameter determined by the third harmonic frequency of the ultrasound. Excellent reproducibility of the results as shown in FIGS. 6–11 should be noted as evidence of the careful performance of these procedures.

The calculated ζ's of the capillary waves with wavelengths (assumed to be twice the peak diameters) of 80 μm, 170 μm, 400 μm, and 600 μm based on the aforementioned resonant capillary waves mechanism are listed in Table II. From these ζ's temporal functions of the relative growth of amplitude scaled to its initial value, i.e. $A/A_o=e^{\zeta t}$, are calculated using the 170 μm capillary waves as a reference. The results for atomization times of 50 μs and 100 μs are shown in FIGS. 12 and 13, respectively. Two values (0.3 and 0.5) of the Jeffrey's sheltering factor β are used in each figure. A comparison of FIG. 12 with FIG. 13 reveals that the relative amplitude growths for 40 μm and 80 μm capillary waves (with respect to 170 μm capillary waves) increase while those for ≧400 μm waves decrease when either the atomization time or β increases; the effects are more pronounced at higher air velocities.

No significant amounts of drops larger than 200 μm diameter are produced in two-fluid atomization of water at 17.3 cc/min and 250±20 m/s air velocity (see FIG. 8*a*) or at 5.1 cc/min water flow rate and 160 m/s air velocity (see FIG. 6*a*). Therefore, no such large drops are expected in ultrasound-modulated two-fluid atomization. Since the ratio of the amplitude growth $A/A_o$ in 50 μs for the capillary waves of 80 μm and 170 μm wavelengths is 5:1 with β=0.3 or 20:1 with β=0.5 at 150 m/s air velocity. Since the ratio of peak frequency at 40 μm diameter to that at 80 μm diameter obtained in ultrasonic atomization (see FIG. 5) is about 0.3:1, the ratio of the initial amplitude of the 80 μm capillary waves to that of the 170 μm waves may be taken as 0.3. Therefore, only 40 μm drops are expected in ultrasound-modulated two-fluid atomization at 5.1 cc/min water rate and 150–160 m/s air velocity. The expectation of only 40 μm drops is born out by experimental results shown in FIG. 6*b*. Likewise, the ratio of amplitude growth $A/A_o$ with β=0.3 for the capillary waves of 80 μm and 170 μm wavelengths is 250:1 at 250 m/s air velocity. Indeed, only 40 μm-diameter drops are seen in FIG. 8*b* for ultrasound-modulated atomization at 17.3 cc/min water rate and 250±20 m/s air velocity. Note that the fraction of waves exposed to wind at constant air flow rate decreases as the water flow rate increases. Therefore, β is taken as 0.5 at 5.1 cc/min and 0.3 at 17.3 cc/min water flow rates.

Figure 8A:
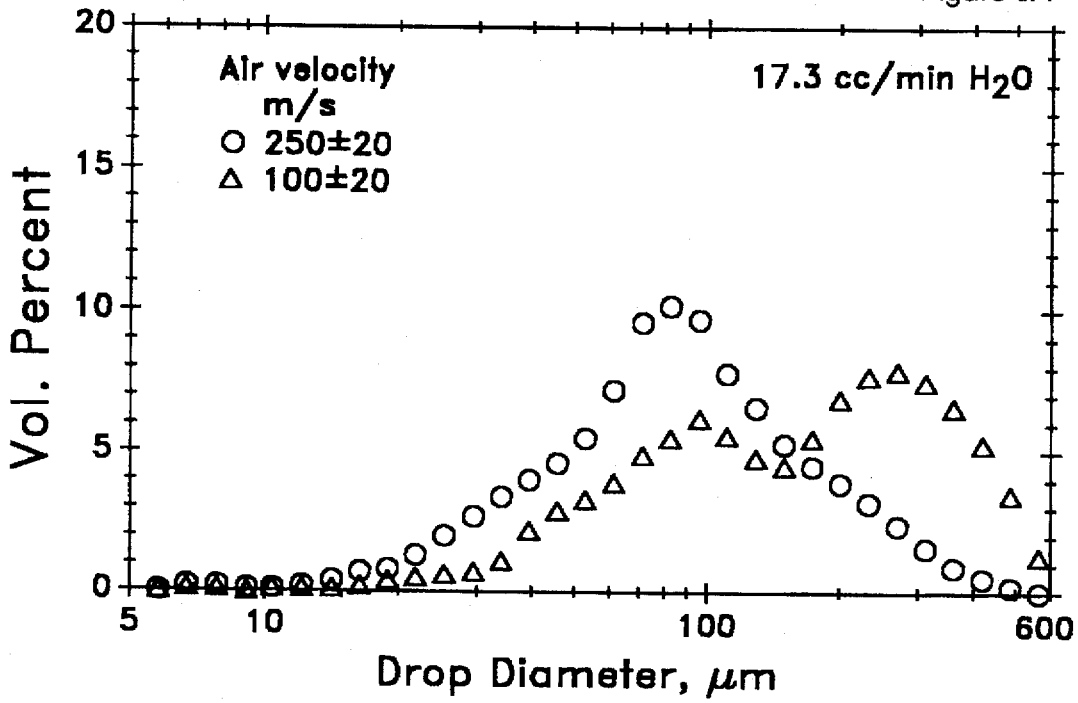
Figure 8B:
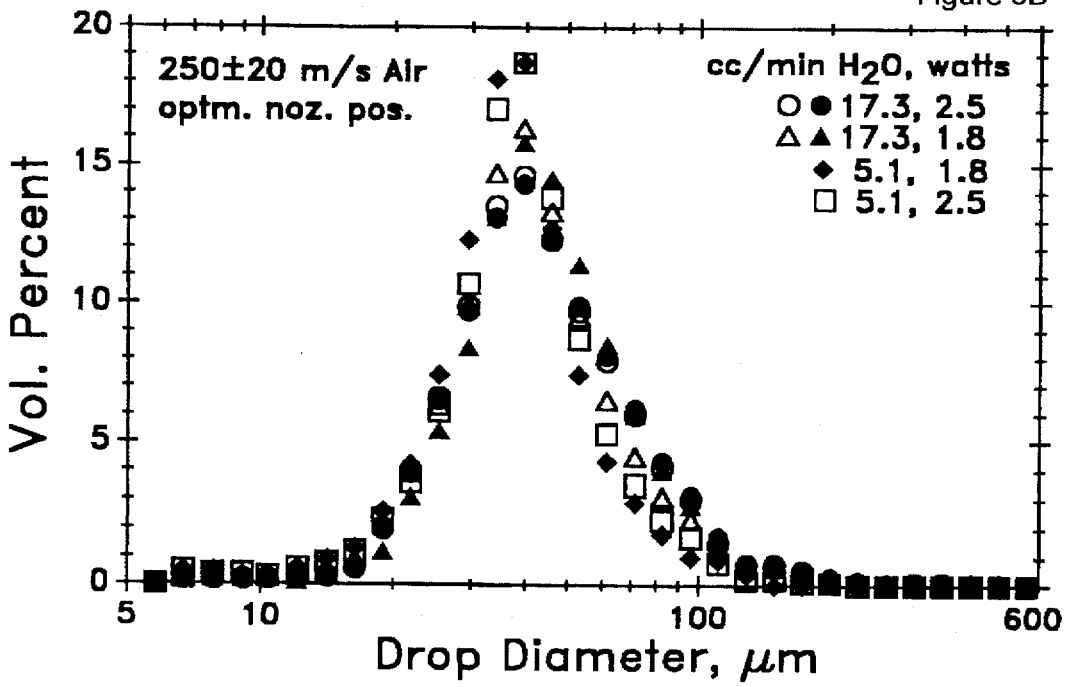

In contrast, significant amounts of drops larger than 200 μm diameter are produced in two-fluid atomization either at 5.1 cc/min water rate and 80 m/s air velocity (see FIG. 7*a*) or at 17.3 cc/min water rate and 100±20 m/s air velocity (FIG. 8*a*). Therefore, capillary waves with wavelengths longer than 400 μm should be taken into consideration in ultrasound-modulated two-fluid atomization at air velocity ranging from 80 to 100 m/s. FIG. 12 shows that the ratio of the amplitude growth $A/A_o$ at 100 m/s air velocity and 50 82 s atomization time for the capillary waves of 80 μm, 170 μm, and 400 μm wavelengths are 1.8:1:0.5 and 3:1:0.4 for β=0.3 and 0.5, respectively. The corresponding ratios at 100 μs atomization time are 2.5:1:0.3 and 8:1:0.1. All are on the same order of magnitude.

Ultrasound has a drastic effect on the drop size and size distribution of airblast atomization of a water jet. This effect can be attributed to resonance between the capillary waves generated by ultrasound and those by high-velocity air. Specifically, capillary waves are first generated on the cone of liquid film at the nozzle tip when a water jet issues from the nozzle vibrating at an ultrasonic frequency. Subsequently, the amplitude of the capillary waves on the liquid film is amplified downstream by blowing air around it, resulting in jet atomization with drop size and size distribution determined by the ultrasonic frequency. Theoretical calculations based on the amplitude growth theory for such resonant capillary waves give remarkable agreement with the experimental results of drop size and size distribution with regard to the effects of air velocity and water flow rate. Narrowly sized drops of diameter determined by the frequency of the third harmonic of the ultrasound can be obtained by controlling the air velocity. These new findings provide not only direct evidence of the capillary wave mechanism for two-fluid atomization but also a new means of controlling drop size and size distribution in two-fluid atomization.

Referring now to FIG. 14, the present invention is shown in greater detail with respect to the ultrasonic atomizer nozzle and channel means (annulus). Nozzle 1 forms an Outlet 2 for the liquid stream, as shown in FIG. 2. Channel Means 3 are cylindrical or conical walls generally forming an annular space for the flow of the impinging gas stream over and around Nozzle 1. Nozzle 1 is situated so that the liquid stream flows in substantially the same direction as the impinging gas stream. The liquid stream may have substantial wave motion and/or perhaps cavitation bubbles arising and collapsing as it passes through Nozzle 1. When the liquid stream issues from Nozzle 1, it passes into an Region 10, in which wave amplitude grows quickly through resonance as described above but is still substantially stable. Region 11 is a subdivision of Region 10 and is separated to point out that the gas stream flow is over the liquid stream as it issues from Nozzle 1 is not sufficiently developed to generate significant wave motion on the liquid stream. Region 12 is a second subdivision of Region 10 and is the region of significant resonance of gas stream-generated waves with waves generated by the ultrasonic atomizer. It is in Region 12 that the gas stream will have established a flow generally in the direction of the liquid stream so that waves will be generated on the liquid stream. The distinction is important in the discovery of the present invention that capillary wave motion can be sustained in the liquid stream for at least a short distance from Nozzle 1 without requiring immediate resonant contact with the gas stream. The distinction is also important because it points out that the actual contact time required to establish resonance of the gas stream-generated waves and the ultrasonic atomizer-generated waves is extremely short.

Residence times of the liquid stream in Region 12 may be reduced to as little as 20 μs. The difficulty of measuring the phenomena in the very short distances from Nozzle 1 for Region 10 (about 1–5 mm) prevents an extremely precise physical measurement of the actual gas flow contact time. The apparent residence time from the nozzle outlet to the point of wave instability (atomization) appears to be about 50–100 μs, which would include both the Region 11 and Region 12. Region 13 represents the transition from a liquid stream of destabilized and shattered by excessive amplitude wave motion to substantial atomization. Region 14 is the region in which the average droplet size and size distribution have been well established and stabilized. Fine modulation of the velocity of the impinging gas stream is preferably made by making Nozzle 1 adjustable up and down within Channel Means 3.

Nozzle 1, although preferably an extension of the housing of an ultrasonic atomizer, may be simple outlet formed in the housing of an ultrasonic atomizer. The Channel Means 3 may be advantageous designed to direct the flow of the impinging gas to create a component of gas flowing substantially parallel to the liquid stream when Nozzle 1 is just such a simple outlet in the housing of an ultrasonic atomizer. It is within the scope of the present invention to direct the flow of liquid stream vertically downward, upward, horizontally or in any other direction that processing of the droplets is required.

To the skilled person, the above specific examples are not limiting of the present invention. The specific design of an ultrasonic atomizer used to achieve the objects of the present invention may produce fundamental and harmonic frequencies quite different from those described above and still achieve the objects of the invention. It is understood by the skilled person that the node-antinode arrangement of the vibration generating portion of an ultrasonic atomizer might be so designed to permit generation of only even or only odd harmonics of a fundamental frequency. Thus, according to the objects of the present invention, it will be preferred that the judicious selection of the node-antinode arrangement in an ultrasonic atomizer device will enable the skilled designer to choose from the fundamental or one of the first five harmonics wavelengths as the primary wavelength from which droplets are generated.

The specific configuration of the ultrasonic atomizer nozzle may be quite different from the one described above, although such a change of configuration might require adaptation of the channel which directs a flow of gas to contact the stream of liquid issuing from the ultrasonic atomizer nozzle. Such adaptation would be within the means of the skilled person with the disclosure made herein.

The range of applications for use of the present invention include processes wherein the liquid droplets will be further vaporized, dried, combusted, applied as a film or encapsulated or coated to form microspheres. Exemplary of those processes are spray drying, fuel atomization and spray coating. The challenge of using sonicating energy in atomization in the prior art has been that a fundamental wavelength and its harmonics find expression in droplet formation, thus forming a broad droplet size distribution.

There is no teaching in the prior art that impinging gas-generated waves may be advantageously resonated with liquid capillary waves. There is additionally no teaching that such a combination could predictably cause narrowing of average droplet size and droplet size distribution in ultrasound-modulated two-fluid atomization, as taught by the present invention.

It appears that the prior art has not taught the basic concept of two fluid atomization with ultrasonic or ultrasound modulated atomization. The prior art uses ultrasonic atomization on a stream of liquid moving free of a vibrating surface and substantially out the flow of an impinging stream of gas. In the typical two-fluid atomization, a stream of liquid issues from a conduit to contact a stream of gas with such collision force that forced entrainment of the gas into the stream of liquid assists atomization. In the prior art, the impinging gas in two-fluid atomization contacts the liquid stream before substantial atomization is achieved. As described in the prior art above, gas streams have not been substantially collided with liquid streams from the vibrating surface. Instead, substantial atomization occurs before collision energy of a gas stream is used to direct or further enhance atomization.

TABLE I

Minimum Air Velocity for Temporal Amplitude Growth of the Capillary Waves

| | | | | | | | |
|---|---|---|---|---|---|---|---|
| $\lambda_C$, m | 24 | 40 | 51 | 80 | 170 | 400 | 600 |
| f, kHz | 174 | 83 | 58 | 29 | 9.5 | 2.6 | 1.4 |
| $V_A^{min}$, m/s | 109 | 75 | 63 | 44 | 25 | 13 | 10 |

TABLE II

ζ's of Capillary Waves Generated by Ultrasound and Air $$\zeta = \left[ \frac{\pi\beta\rho_A(V_A - u)^2}{\lambda\rho u} - \frac{8\pi^2\eta}{\rho\lambda^2} \right] \quad (1)$$

| $V_A$, m/s | $\lambda_C$, m | ζ, $s^{-1}$, β = 0.3 | ζ, $s^{-1}$, β = 0.5 | $V_A$, m/s | $\lambda_C$, m | ζ, $s^{-1}$, β = 0.3 | ζ, $s^{-1}$, β = 0.5 |
|---|---|---|---|---|---|---|---|
| 250 | 40 | $4.91 \times 10^5$ | $8.51 \times 10^5$ | 100 | 40 | $3.37 \times 10^4$ | $8.90 \times 10^4$ |
| 250 | 80 | $3.73 \times 10^5$ | $6.30 \times 10^5$ | 100 | 80 | $4.76 \times 10^4$ | $8.75 \times 10^4$ |
| 250 | 170 | $2.63 \times 10^5$ | $4.40 \times 10^5$ | 100 | 170 | $3.90 \times 10^4$ | $6.68 \times 10^4$ |
| 250 | 400 | $1.74 \times 10^5$ | $2.90 \times 10^5$ | 100 | 400 | $2.70 \times 10^4$ | $4.53 \times 10^4$ |
| 250 | 600 | $1.43 \times 10^5$ | $2.37 \times 10^5$ | 100 | 600 | $2.23 \times 10^4$ | $3.74 \times 10^4$ |

I claim:

1. A process for ultrasound-modulated two-fluid atomization wherein capillary waves are generated by ultrasound within a liquid stream passed from a conduit to an outlet of the conduit comprising:

(a) a substantially non-atomized liquid stream issuing free of the conduit and outlet, the substantially non-atomized liquid stream with an outer surface having waves at a fundamental frequency and harmonics above about 10 kHz and (b) flowing a gas stream on the surface of the liquid stream to generate waves in resonance with at least one of the frequencies of the waves in the liquid stream.

2. The process of claim 1 wherein the liquid stream issues from a nozzle situated in channel means for directing the gas stream to impinge upon the liquid stream.

3. The process of claim 2 wherein the nozzle is an extension of liquid stream outlet of an ultrasonic atomizer.

4. The process of claim 1 wherein the resonance occurs with substantially only one harmonic of the waves in the liquid stream.

5. The process of claim 4 wherein the liquid stream issues from a nozzle situated in channel means for directing the gas stream to impinge upon the liquid stream and the liquid stream is dispersed substantially entirely into droplets between about 1 to 10 millimeters from the issuing end of the nozzle.

6. The process of claim 1 wherein the impinging gas flows in substantially the same direction as the stream of liquid.

7. The process of claim 1 wherein the liquid stream issues from a nozzle situated in channel means for directing the gas stream to impinge upon the liquid stream and the nozzle is adjustable within the channel means to modulate the gas stream velocity.

8. The process of claim 1 wherein the liquid stream contains fine particles.

9. The process of claim 8, wherein the concentration of fine particles in the liquid stream is sufficiently high to comprise a suspension, dispersion or slurry.

10. The process of claim 1 wherein the liquid stream issues from a nozzle situated in channel means for directing the gas stream to impinge upon the liquid stream and the gas stream velocity is controlled by changing the flow rate of the gas stream.

11. The process of claim 10 wherein the flow rate of the gas stream is sufficient to cause a gas stream flow velocity of from about 50 to 300 meters per second between the channel means and the nozzle.

12. The process of claim 11 wherein the fundamental frequency of the waves in the liquid stream is about 58 kHz.

13. The process of claim 12 wherein a third harmonic frequency of the waves in the liquid stream is about 174 kHz.

14. The process of claim 13 wherein the ultrasonic atomizer power input is from about 1.0 to 3.5 watts.

* * * * *